United States Patent [19]

Paulus et al.

[11] Patent Number: 4,687,053

[45] **Date of Patent: * Aug. 18, 1987**

[54] HEAT EXCHANGER PANEL AND MANUFACTURING METHOD THEREOF

[75] Inventors: Manfred Paulus, Pforzheim; Norbert Frömel, Eisingen, both of Fed. Rep. of Germany

[73] Assignee: Fr. Kammerer GmbH, Pforzheim, Fed. Rep. of Germany

[ * ] Notice: The portion of the term of this patent subsequent to Dec. 27, 2000 has been disclaimed.

[21] Appl. No.: 637,224

[22] PCT Filed: Nov. 23, 1983

[86] PCT No.: PCT/EP83/00313

§ 371 Date: Jul. 26, 1984

§ 102(e) Date: Jul. 26, 1984

[87] PCT Pub. No.: WO84/02178

PCT Pub. Date: Jun. 7, 1984

[30] Foreign Application Priority Data

Nov. 26, 1982 [DE] Fed. Rep. of Germany ..... 3243713

[51] Int. Cl.[4] ..... F28F 13/18

[52] U.S. Cl. ..... 165/133; 29/157.3 D; 228/117; 228/157; 228/190

[58] Field of Search ..... 165/133; 228/117, 157, 228/190; 29/157.3 D

[56] References Cited

U.S. PATENT DOCUMENTS

| | | | |
|---|---|---|---|
| 3,349,469 | 10/1967 | Muije et al. | 228/190 X |
| 3,470,607 | 10/1969 | Rader et al. | 228/117 |
| 4,011,982 | 3/1977 | Marancik | 228/117 X |
| 4,021,901 | 5/1977 | Kleine et al. | 29/157.3 D |
| 4,078,604 | 3/1978 | Christl et al. | 165/133 |
| 4,209,885 | 7/1980 | Winter | 228/117 X |
| 4,423,120 | 12/1983 | Paulus et al. | 228/117 X |

FOREIGN PATENT DOCUMENTS

| | | | |
|---|---|---|---|
| 2921770 | 12/1980 | Fed. Rep. of Germany | 165/133 |

*Primary Examiner*—Albert W. Davis, Jr.
*Assistant Examiner*—Peggy A. Neils
*Attorney, Agent, or Firm*—Antonelli, Terry & Wands

[57] ABSTRACT

Heat exchanger panel and process of making such panel comprised of selectively clad or bonded metal plates made of a material which cannot be cold roll bonded without great difficulty, if at all, with at least one channel disposed therebetween. An adhesive layer of an amorphous metal is provided between the plates for permanently joining the plates together by cold roll bonding in the area of the adhesive layer.

21 Claims, 4 Drawing Figures

HEAT EXCHANGER PANEL AND MANUFACTURING METHOD THEREOF

The invention relates to a heat exchanger panel comprised of two selectively clad metal plates, and at least one channel disposed between these plates for a liquid or gaseous medium to be heated or cooled, flowing therethrough.

The invention is used in heat exchangers employed in solar installations, seawater desalination, chemical engineering, and food chemistry, especially in all applications where aggressive or corrosive media are used as heat carriers.

Heat exchangers serve to transfer thermal energy between two liquid or gaseous media at different temperatures, which are to be either cooled or heated.

Flat heat exchangers consist of metal panels comprising one or more channels to receive a medium conducted therethrough. Such heat exchanger panels are used as panel stacks for compact heat exchangers or as large-area single panels, for example to absorb solar energy.

Various designs of heat exchanger panels are known. Thus, for example, German OS 29 02 640 discloses a heat exchanger element with two metal layers made of aluminum, located side by side, and a metal tube disposed therebetween for the heat carrier. Because aluminum is insufficiently resistant to corrosion, the metal tube is made of copper, entailing not insignificant manufacturing problems. In order to manufacture the heat exchanger panel described in German OS 28 47 897, holes must be drilled in a metal block to receive a welding resist, so that the areas of the holes are not welded during the subsequent rolling process, and can then be expanded into channels. The provision of the holes, however, is a rather expensive procedure and several additional work steps are required to remove the welding resist, which is necessary to inhibit undesirable corrosion. Finally, German Pat. No. 21 23 628 teaches a panel-shaped heat exchanger made by pressure welding plating from two strips of an appropriate metal for standard cladding processes; it has a lengthwise channel located in the rolling direction. In the area of this future lengthwise channel, a layer which counteracts welding is applied before bonding to one strip, said layer allowing the channel to be widened. A heat exchanger panel manufactured in this fashion is relatively expensive to make and can be produced only from metals which can be bonded using conventional cladding processes.

The goal of the invention is to design a heat exchanger panel which is less complicated to engineer and less expensive to manufacture, and which can be used in a variety of ways.

To achieve the set goal, a heat exchanger panel of the design described hereinabove is used as the starting point and the goal is achieved by having the panels made of a material which cannot be clad or can be clad only with difficulty using conventional cladding processes, by the fact that an adhesive layer of an amorphous metal is provided between the two strip-like cladding components and on both sides close to the channel, and by the fact that the strips are firmly joined together by cold roll bonding in the area of the adhesive layer. The manufacture of a heat exchanger panel of this kind by the cold bonding method using an interlayer of amorphous metal is very simple and the adhesive layer makes it possible to use metals for panels which could previously be used only by very complicated and expensive cladding processes.

To favor heat transfer, the two strips are advantageously made of copper or copper alloy.

The adhesive layer according to the invention consists of an amorphous nickel, iron, or copper alloy and contains components which delay crystallization, namely silicon, boron, phosphorus, aluminum, and/or carbon.

According to another important feature of the invention, each strip is clad with a cover layer. This cladding procedure may also use according to the idea of the invention, an adhesive layer of amorphous metal.

In an especially advantageous embodiment of the invention, the cover layers on the strips are made of a metal which is resistant to aggressive and/or corrosive media, whereby titanium or a titanium alloy or tantalum or a tantalum alloy is used as a metal for the cover layer. If the channels of the heat exchanger panel according to the invention are to receive an aggressive medium, the two strips will have their resistant cover layers on the inside, facing the channels; however if the aggressive medium is to flow on the outer surfaces of the heat exchanger panel, the aggression resistant cover layers are on the outside and the two, usually copper, strips are clad on top of one another according to the invention. The use of a cover layer of this kind allows highly economical use of the very expensive corrosion-resistant metal.

In the manufacture of heat exchanger panels according to the invention, a method is proposed in which two metal strips uncoiled from supply rolls are joined together at predetermined areas by cold roll bonding using a cladding mill. After cladding, the strip is cut into panels, after which the areas with poor adhesion are expanded to form at least one channel. Good adhesion is attained by using an adhesive interlayer of amorphous metal between the strip-like clad components. In cases where the interlayer is inserted only at distinct areas, a selective clad product will result. This explains why those metal strips leading to poor adhesion when employing conventional cladding processes are used. Each metal strip can have a clad cover layer, for example made of a corrosion-resistant material. This process is extraordinarily flexible with respect to the design of the heat exchanger panels to be manufactured.

The adhesive layer is either a foil of amorphous metal or is applied as a surface layer to at least one of the metal strips.

The adhesive layer can consist of strips arranged separately from each other and the strips can be disposed parallel and perpendicular to each other between the components before bonding.

Advantageously, the adhesive layer consists of two strips, designed in the shape of combs and interlocked together, permitting manufacture of a heat exchanger panel with a meandering flow channel which requires only two connections, one for the inlet and one for the outlet of the medium. With another embodiment, a metal screen can be used to form the adhesive layer, which has on at least a portion of its intersections, small plates of amorphous metal. By using a metal screen of this kind, the manufacture of a heat exchanger panel with multiply branched channels can be accomplished in simple fashion. To expand the channels, the panels are advantageously placed in a mold of appropriate shape.

The invention will now be described in greater detail with reference to the attached drawings.

Figure 1:
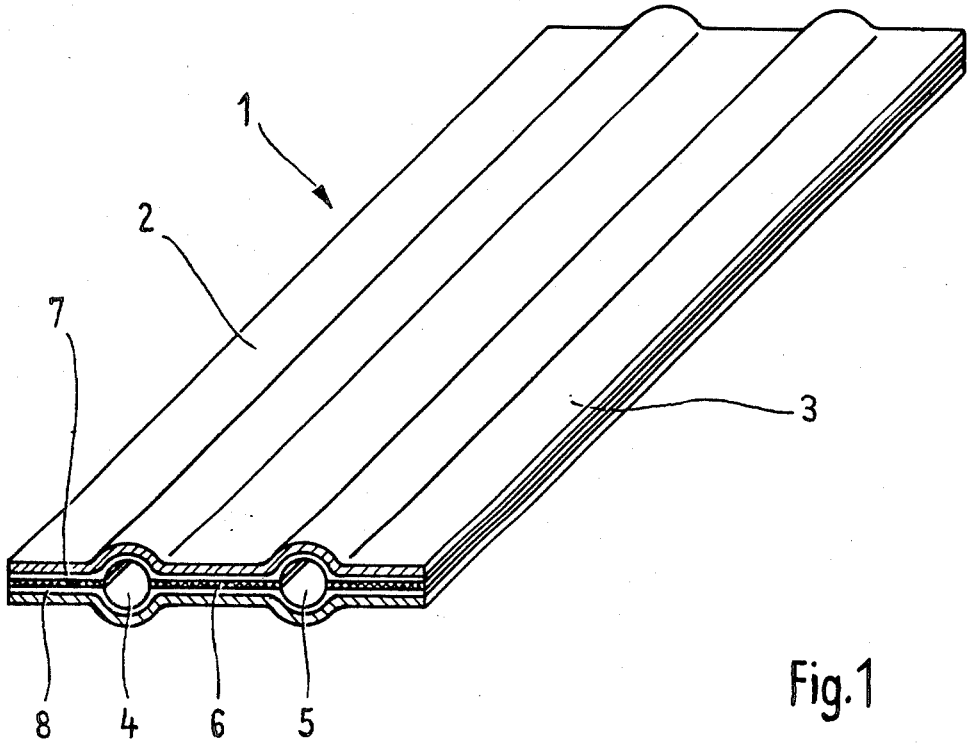
FIG. 1 is a heat exchanger panel with two parallel channels shown in perspective view.

A heat exchanger panel 1 according to the invention consists (see FIG. 1) of two plates 2 and 3 made of metal strips, clad selectively, between which two channels 4 and 5 are disposed. These two channels 4 and 5 serve to conduct a liquid or gaseous medium to be heated or cooled, flowing therethrough.

The two plates 2 and 3 consist of a metal which can be joined poorly or not at all by a cladding process. Between plates 2 and 3 is an amorphous metal interlay 6 which serves as an adhesion promoter and which is applied close to and on both sides of channels 4 and 5. In the area of this adhesive layer 6, the two strips 2 and 3 are firmly joined together by cold roll banding.

Adhesive layer 6 consists of an amorphous nickel, iron, or copper alloy which contains crystalline-delaying components namely, in particular, silicon, boron, phosphorus, aluminum, and/or carbon. This adhesive layer 6 can be a foil, applied between the two strips 2 and 3 before the cold roll bonding, but it is also possible to produce adhesive layer 6 by irradiating the surface of one of the two strips 2 or 3 with laser light.

The two strips 2 and 3, made of copper for example, each can have a more or less thin cover layer 7 or 8 applied by cold roll bonding before selectively cladding the two strips 2 and 3. In heat exchanger panel 1 shown in FIG. 1, these cover layers 7 and 8 face adhesive layer 6 or the interiors of channels 4 and 5 but, if the application requires it, they can also be applied to the outside of heat exchanger panel 1.

The two cover layers 7 and 8 consist of a material resistant to aggressive and/or corrosive media, namely titanium or tantalum or a titanium or tantalum alloy.

Figure 2:
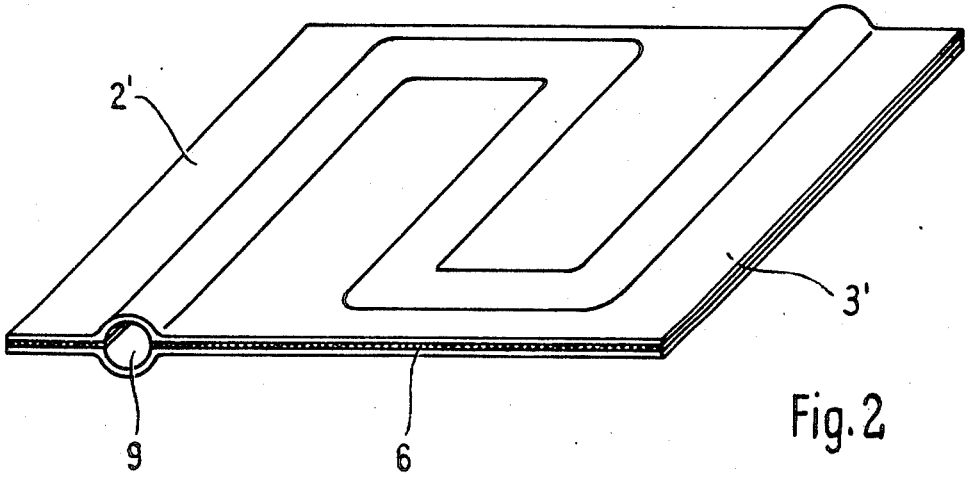
FIG. 2 is a heat exchanger panel with a meandering flow channel, in perspective view.

The heat exchanger panel 1 shown in FIG. 2 is likewise composed of two strips 2' and 3', made of copper and joined together by cold roll bonding with interposition of an adhesive layer 6. A meandering flow channel 9 is formed between the two strips 2' and 3'.

The heat exchanger panel according to the invention is manufactured by applying an adhesive layer made of an amorphous metal (for example a nickel, iron, or copper alloy with crystallization-delaying components) at certain areas between two metal strips to be clad and is made of a material which can be clad only with difficulty, if at all when applying conventional bonding processes, namely copper for example. These two metal strips are then joined together by a cold roll bonding process using a cladding mill and an amorphous metal interlayer, whereby the adhesion is produced only at the areas where the adhesive layer is located. Then the clad metal strips are cut up into individual panels, and finally the segments which were not joined are separated and expanded to form one or more channels for a medium to be warmed or cooled in the usual fashion.

Figure 3:
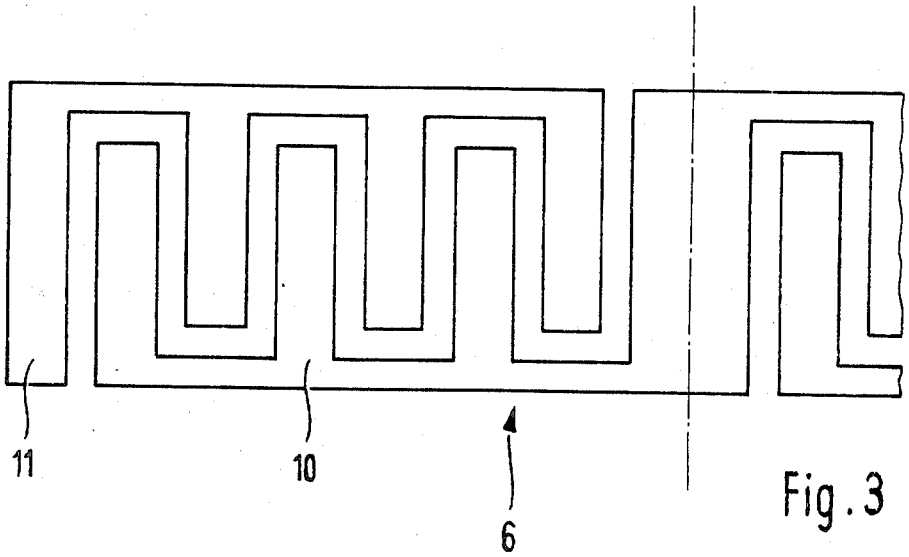
FIG. 3 is a two-part adhesive layer of an amorphous metal designed in the shape of combs and interlocked together for a heat exchanger panel with a meandering flow channel, shown in a top view.

FIG. 3 shows an adhesive layer 6 made of an amorphous metal foil in the form of two comb-shaped interlocking strips 10 and 11. This adhesive layer 6 makes it possible to manufacture heat exchanger panels which have a meandering foil channel. The dot-dash line indicates the point at which the cut to separate the panels is made after cold roll bonding.

Figure 4:
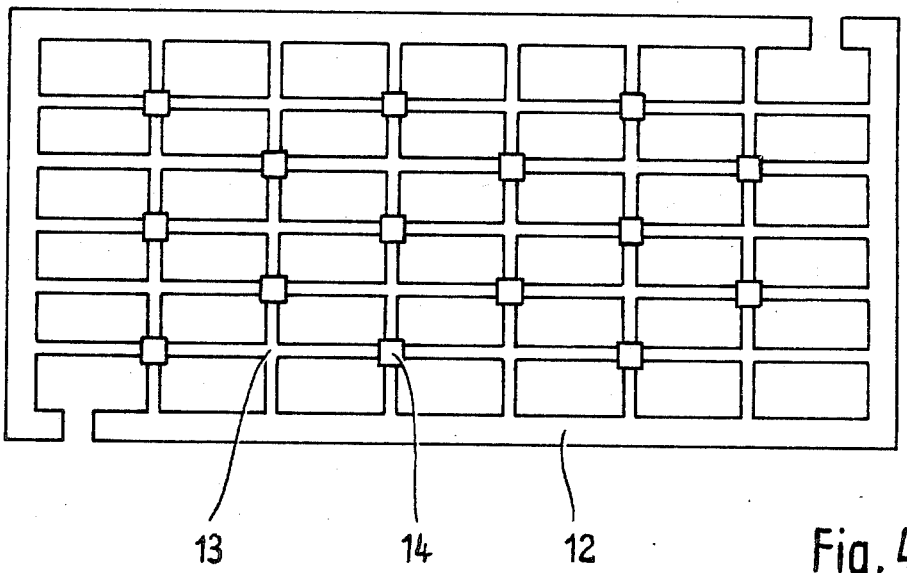
FIG. 4 is a metal screen serving to form an adhesive layer, with small plates of an amorphous metal disposed at its intersections, shown in top view.

To manufacture heat exchanger panels in which the two adjacent strips are to be joined together only at certain points to form multiply branched channels, a metal screen 12 made for example from a foil is used, as shown in top view in FIG. 4. This metal screen 12 has, on a portion of its intersections 13, small square plates 14 made of an amorphous metal. When a metal screen 12 of this kind, which is preferably made of the same metal as the strips, is inserted between the metal strips which can be clad only with difficulty if at all before the cold roll bonding process, these strips will then be joined together only at certain points.

LIST OF REFERENCE NUMBERS USED

1 heat exchanger panel
2, 2' plate
3, 3' plate
4 channel
5 channel
6 amorphous metal interlayer
7 cover layer
8 cover layer
9 channel
10 comb-shaped strip
11 comb-shaped strip
12 metal screen
13 intersection
14 small plate amorphous metal

What is claimed:

1. Heat exchange panel comprised of two selectively clad metal plates and at least one channel disposed between these plates for a liquid or gaseous medium flowing therein to be warmed or cooled, wherein the plates are made of a material which can be cold roll bonded only with difficulty or not at all when using conventional cladding processes, and an adhesive layer made of an amorphous metal is provided between the two plates and on both sides of and in proximity to said at least one channel, the plates being permanently joined together by cold roll bonding in the area of the adhesive layer.

2. Heat exchanger panel according to claim 1, wherein the adhesive layer is an amorphous metal foil.

3. Heat exchanger panel according to claim 1, wherein the adhesive layer is a surface layer on at least one of the two plates.

4. Heat exchanger panel according to one of claims 1 to 3, wherein the plates are made from a material consisting of copper and a copper alloy.

5. Heat exchanger panel according to claim 2, wherein the foil contains crystallization-delaying components and consists of an amorphous metal consisting of amorphous nickel, amorphous iron, and amorphous copper alloy.

6. Heat exchanger panel according to claim 5, wherein the crystallization-delaying components comprise at least one component consisting of silicon, boron, phosphorus, aluminum and carbon.

7. Heat exchanger panel according to one of claims 1 to 6, wherein a cover layer is clad on each plate.

8. Heat exchanger panels according to claim 7, wherein the cover layers are made of a metal which is resistant to aggressive media or to corrosive media or to both aggressive and corrosive media.

9. Heat exchanger panel according to claim 8, wherein the cover layers are made of titanium.

10. Heat exchanger panel according to claim 8, wherein the cover layers are made of tantalum.

11. Heat exchanger panel according to claim 8, wherein the cover layers are made of stainless chromium-nickel steel.

12. Process for manufacturing heat exchanger panels, comprising the steps of uncoiling two metal strips from supply rolls, the metal strips consisting of a material which can be cold roll bonded only with difficulty or not at all when using a conventional bonding process, introduding an amorphous metal adhesive layer between the metal strips at predetermined areas thereof to be joined, cold roll bonding together the metal strips at the predetermined areas by means of a cladding mill, cutting the strips into panels, and separating and expanding at areas other than the predetermined areas to form at least one channel between the panels.

13. Process according to claim 12, including the further step of bonding a cover layer on each metal strip before cold roll bonding together the metal strips.

14. Process according to claim 12, wherein the adhesive layer is an amorphous metal foil.

15. Process according to claim 12, including the step of applying the adhesive layer as a surface layer to at least one of the metal strips.

16. Process according to one of claim 12, wherein the adhesive layer consists of strips arranged separately from one another.

17. Process according to claim 16, wherein the strips are arranged parallel and perpendicularly to each other.

18. Process according to one of claim 12, wherein the adhesive layer consists of two comb-shaped interlocking strips.

19. Process according to one of claim 12, wherein the adhesive layer is formed by a metal screen carrying small amorphous metal plates on at least a portion of intersections forming the screen.

20. Heat exchanger panel according to claim 8, wherein the cover layers are made of titanium alloy.

21. Heat exchanger panel according to claim 8, wherein the cover layers are made of tantalum alloy.

* * * * *